US010483053B2

(12) United States Patent
Mendoza

(10) Patent No.: US 10,483,053 B2
(45) Date of Patent: Nov. 19, 2019

(54) SWITCH COVER

(71) Applicant: ABB Schweiz AG, Baden (CH)

(72) Inventor: Malbin Jose Mendoza, Weston, FL (US)

(73) Assignee: ABB Schweiz AG, Baden (CH)

( * ) Notice: Subject to any disclaimer, the term of this patent is extended or adjusted under 35 U.S.C. 154(b) by 82 days.

(21) Appl. No.: 15/225,330

(22) Filed: Aug. 1, 2016

(65) Prior Publication Data

US 2018/0033566 A1 Feb. 1, 2018

(51) Int. Cl.

| | |
|---|---|
| ***H01H 9/22*** | (2006.01) |
| ***H01H 9/02*** | (2006.01) |
| ***H01H 1/00*** | (2006.01) |
| ***H01H 1/42*** | (2006.01) |
| ***H01H 85/25*** | (2006.01) |
| ***H01H 71/02*** | (2006.01) |

(52) U.S. Cl.

CPC ..... *H01H 9/0207* (2013.01); *H01H 1/0015* (2013.01); *H01H 1/42* (2013.01); *H01H 9/22* (2013.01); *H01H 71/0264* (2013.01); *H01H 85/25* (2013.01); *H01H 2223/044* (2013.01)

(58) Field of Classification Search

CPC .... H01H 9/0207; H01H 9/0264; H01H 9/045; H01H 9/22; H01H 9/287; H01H 71/0264; H01H 85/25; H01H 2223/044

See application file for complete search history.

(56) References Cited

U.S. PATENT DOCUMENTS

| | | | | |
|---|---|---|---|---|
| 1,656,151 A * | 1/1928 | Thomas | H01H 15/18 | 200/302.1 |
| 3,040,151 A * | 6/1962 | Reihman | H01H 19/025 | 200/11 EA |
| 6,220,901 B1 * | 4/2001 | Fisher | H01R 13/516 | 439/709 |
| 6,558,167 B2 * | 5/2003 | Harmon | B60D 1/62 | 439/35 |
| 6,737,855 B2 | 5/2004 | Huber et al. | | |
| 7,271,357 B2 | 9/2007 | Ostmeier | | |

(Continued)

FOREIGN PATENT DOCUMENTS

| | | |
|---|---|---|
| CA | 2298403 A1 | 8/2000 |
| CA | 2544371 C | 10/2013 |

OTHER PUBLICATIONS

ABB, Inc. FT Flexitest Family—Switches, Covers and Test Plugs brochure, DB41-079 Rev. E, Mar. 2008, https://library.e.abb.com/public (6 pages).

(Continued)

*Primary Examiner* — Felix O Figueroa
(74) *Attorney, Agent, or Firm* — Taft Stettinius & Hollister LLP; J. Bruce Schelkopf

(57) ABSTRACT

A cover for an electric switch assembly is disclosed in the present application. The cover includes connecting features that permit connection to a housing for the switch assembly in at least two locations. A first location is defined by a cover positioned to completely enclose all electrically conductive components in the switch assembly. A second location is defined by a cover positioned to enclose a portion of electrically conductive components and to permit access to a circuit associated with an open switch in the switch assembly.

4 Claims, 7 Drawing Sheets

(56) References Cited

U.S. PATENT DOCUMENTS

| | | | | |
|---|---|---|---|---|
| 7,435,093 | B1 * | 10/2008 | Harmon | B60D 1/64 439/35 |
| D593,961 | S | 6/2009 | Ball et al. | |
| D595,662 | S | 7/2009 | Ball et al. | |
| 8,007,312 | B2 | 8/2011 | Bower et al. | |
| 8,188,396 | B2 | 5/2012 | Bou et al. | |
| 8,300,368 | B2 | 10/2012 | Huang et al. | |
| 8,400,161 | B2 | 3/2013 | Belhumeur et al. | |
| 8,604,366 | B2 | 12/2013 | Bower et al. | |
| 9,110,102 | B2 | 8/2015 | Kesler | |
| 2011/0211283 | A1 | 9/2011 | Haung et al. | |
| 2013/0120090 | A1 | 5/2013 | Ball | |
| 2013/0162264 | A1 | 6/2013 | Belhumeur et al. | |
| 2015/0339908 | A1 | 11/2015 | Masters et al. | |

OTHER PUBLICATIONS

ABB, Inc. FT Flexitest Family Descriptive Bulletin, DB 41-077 Rev D Mar. 2012, https://www.scribd.com/document/75318183/ABB-FT-Switch-Family-Brochure (40 pages).

ABB, Inc. FT Flexitest Switches, https://abb.com/medium-voltage/distribution-automation/test-switch-and-accessories/flexitest-family/ft-1 (4 pages).

* cited by examiner

SWITCH COVER

TECHNICAL FIELD

The present application generally relates to a switch cover and more particularly, but not exclusively, to a switch cover configured to attach to a switch assembly housing in a manner that permits access to certain non-electrified components within the switch assembly housing and restricts contact with certain electrified components therein.

BACKGROUND

Covers for switches are typically configured to enclose an entire opening of a switch assembly housing. Prior art switch covers are temporarily removed when access is required for testing circuits or repairing certain components within the switch assembly housing. When the switch cover is completely removed electrically hot components are exposed which can cause a potential for accidental electrocution. Some existing systems have various shortcomings relative to certain applications. Accordingly, there remains a need for further contributions in this area of technology.

SUMMARY

One embodiment of the present application is a unique switch cover. Other embodiments include apparatuses, systems, devices, hardware, methods, and combinations of a unique switch cover configured to attach to a switch assembly housing in a manner that permits access to internal portions of the switch assembly housing while restricting contact with electrically hot components. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
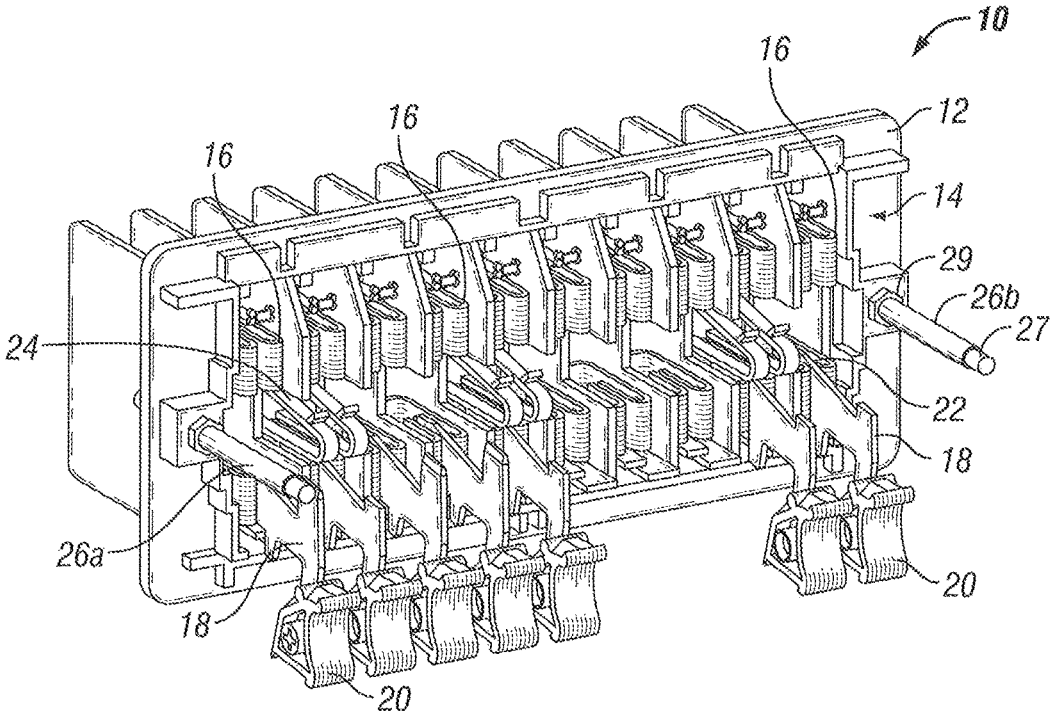
FIG. 1 is a perspective view of an exemplary switch assembly according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring now to FIG. 1, a switch assembly 10 includes a housing 12 for holding a plurality of switches 14 therein. Each switch 14 can include a clamp or jaw 16 and a switch blade 18. The switch blade 18 can pivot between open and closed positions. Each of the blades 18 is shown in an open position to define an open circuit in FIG. 1. Each switch blade 18 can connect with a clip or jaw 16 positioned directly above the blade 18. When the switch blade 18 is in contact within a corresponding jaw 16, the switch is closed and forms a closed circuit. Each of the blades 18 includes a handle or gripping element 20. The handle 20 can be formed of one or more materials that are nonconductive so that an operator may grab or hold onto the handle 20 to move the blade 18 between the open and closed positions without receiving an electrical shock. It should be noted that the switch assembly 10 as illustrated herein is exemplary in nature and may take on other forms without departing from the scope of this disclosure. By way of example and not limitation the switch assembly 10 may have more switches 14 or less switches 14 than that shown in FIG. 1. Furthermore, the switch assembly 10 is shown with three empty slots without a switch 14 for clarity and some preferred embodiments will include a switch 14 in each slot.

Each blade 18 is pivotably connected to a hinge 22 that permits rotational movement of the blade 18 about the hinge 22 such that the blades 18 can be moved between the open and closed positions. Each switch 14 also includes a current jack spring 24 positioned between the jaw 16 and the blade 18. The current jack spring 24 can be used for bypassing the switch 14 to provide current directly to a circuit when the switch assembly 10 is in a test mode. The test mode procedure will be described in more detail below.

The switch assembly housing 12 includes first and second posts or rods 26*a*, 26*b* extending therefrom. Each post or rod 26*a*, 26*b* extends from a first end 27 to a second end 29. The second end 29 of each rod 26*a*, 26*b* can be permanently fixed or removably connected to the housing 12. The first end 27 of each rod 26*a*, 26*b* can include a threaded portion to receive a threaded nut or the like. The rods 26*a*, 26*b* are illustrated as having a cylindrical shape, however this is only intended as a non-limiting example, as other forms and shapes are contemplated by the present disclosure. In some forms threads may be formed along the entire length of the rods 26*a*, 26*b* and in other forms the rods 26*a*, 26*b* may be devoid of threads.

Figure 2:
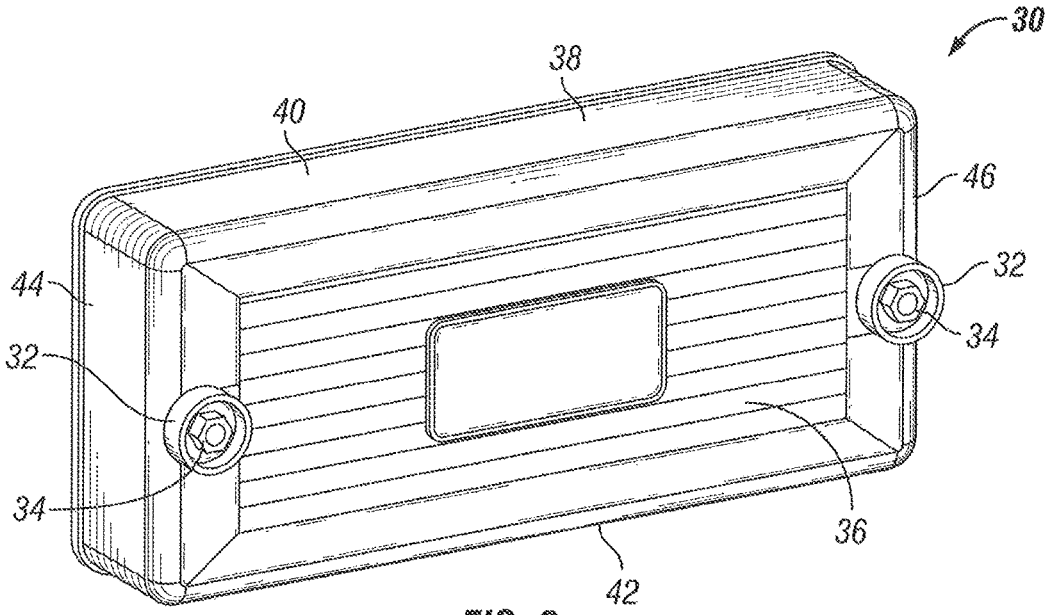
FIG. 2 (Prior Art)
FIG. 2 is a perspective view of a prior art cover for the switch assembly illustrated in FIG. 1.

Referring now to FIG. 2, a prior art cover 30 for the switch assembly 10 is shown. The cover 30 can include a boss 32 at either end thereof that is configured to receive the first end 27 of each rod 26*a*, 26*b* when installed onto the housing 12 of the switch assembly 10 in a first or closed position. A nut 34 can be threadingly engaged with the threaded end 27 of the each rod 26*a*, 26*b* to securely attach the cover 30 to the housing 12. Other forms of fastening such as mechanical clips or the like may be used in some alternative embodiments.

Figure 5:
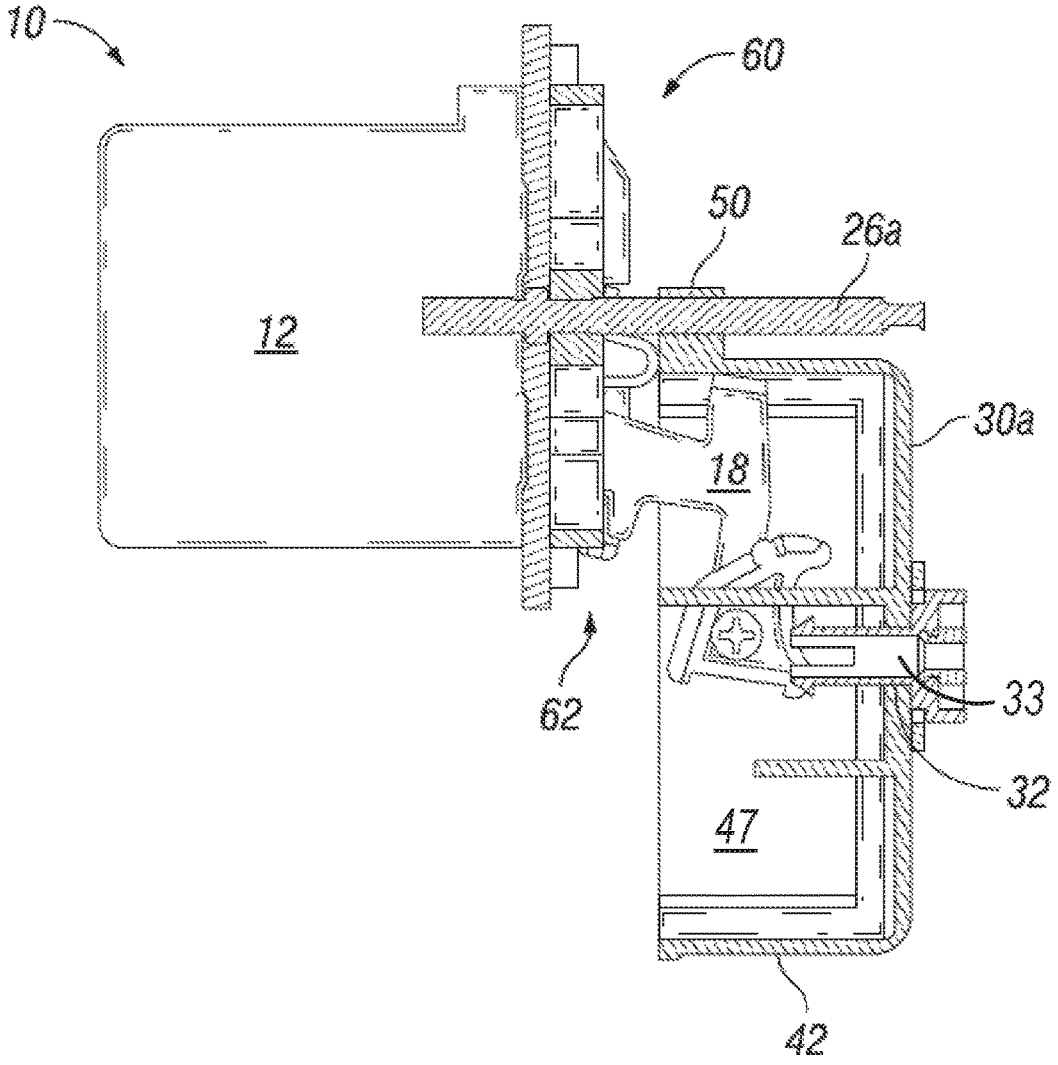
FIG. 5 is a side view of FIG. 4 with portions in cross-section and partially cutaway.

The cover 30 includes a front wall 36 and a perimeter wall 38 formed about the front wall 36. The front wall 36 and perimeter wall 38 can be configured in a rectangular form as shown, but other configurations are contemplated such as by way of example and not limitation a square, a circle or other shapes can be utilized as desired. In the exemplary embodiment, the perimeter wall 38 can include a top wall 40 and a bottom wall 42 and first and second side walls 44, 46, respectively, that define an inner region 47 (FIG. 5) of the cover 30. As seen in FIG. 5, the boss 32 can include an aperture 33 that extends through the front wall 36 to the interior region 37.

Figure 3:
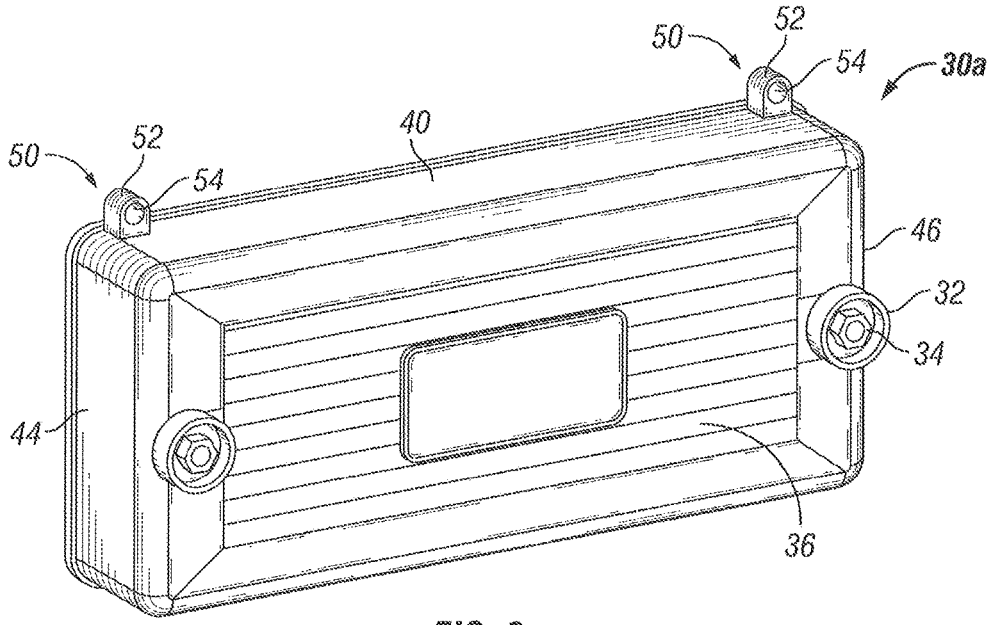
FIG. 3 is perspective view of a switch cover according to one embodiment of the present disclosure.

Referring now to FIG. 3, one exemplary embodiment of the present disclosure is illustrated. A cover 30*a* can include features that are similar to the cover 30 illustrated in FIG. 2. The cover 30*a* can include a pair of eyelets 50 extending from the top wall 40 proximate either side 44, 46 thereof. Each eyelet 50 is defined by an external wall 52 with a through aperture 54 formed internally through the wall 52. The cover 30*a* can be removed from a first or closed position (not shown) with respect to the housing 12 by unfastening the threaded fasteners 34 from the rods 26*a* and 26*b*.

Figure 4:
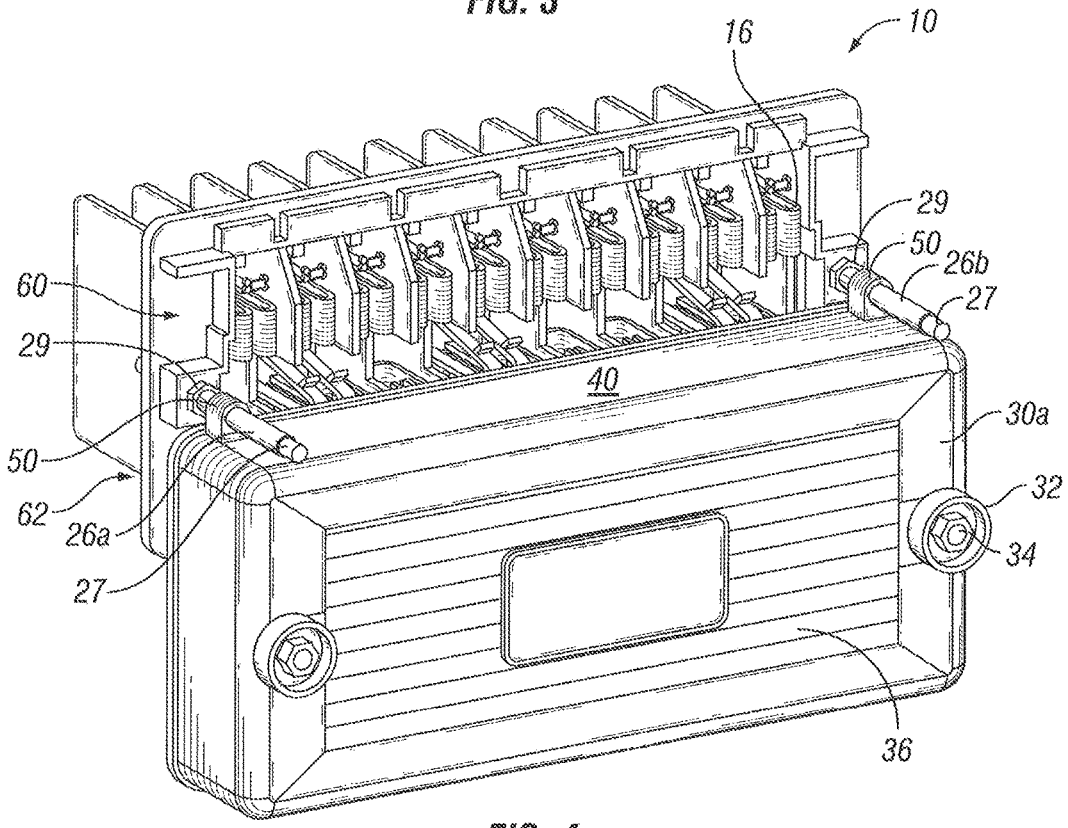
FIG. 4 is a perspective view of switch cover of FIG. 3 attached to the switch assembly of FIG. 1 in a second position.

Referring now to FIG. 4, the cover 30*a* is assembled with the housing 12 of the switch assembly 10 in a second position so as to permit access to an upper portion 60 of the switch assembly 10 while covering the lower portion 62 of the switch assembly 10. The cover 30*a* can be moved to a second position or test position to permit access to an upper portion 60 of the switch assembly 10 while covering the lower portion 62 of the switch assembly 10 so as to prevent an electrical shock to an operator when testing various switch circuits. After removing the cover 30*a* from the first position defined by complete enclosure of the housing 12, the eyelets 50 of the cover 30*a* can be engaged with the rods 26*a*, 26*b* such that the rods 26*a*, 26*b* slide at least partially through the eyelets 50. In this manner the one or more switch blades 18 can be moved to an open position to permit testing or debugging of circuits connected to the switch assembly 10. When the cover 30*a* is in the second position, the jaws 16 of the one or more open switches are accessible in the upper portion 60 and contact with potentially electrically hot components in the lower portion 62 is restricted.

FIG. 5 shows a partial cross-sectional side view of FIG. 4 of the switch assembly 10 wherein a rod 26*a* is engaged through an eyelet 50 to hold the cover 30*a* in a second position that at least partially covers an open blade 18 and other electrical components in the lower portion 62 while providing access to the upper portion 60 of the switch assembly 10.

Figure 6:
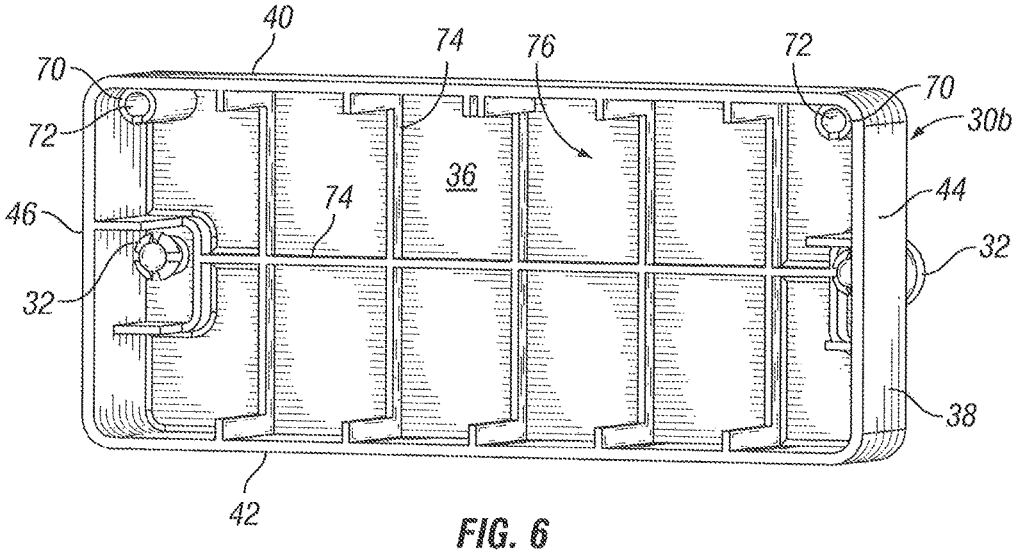
FIG. 6 is a perspective view of a switch cover according to another embodiment of the present disclosure.

Referring now to FIG. 6, a rear perspective view of another embodiment of a switch assembly cover 30*b* is illustrated therein. The cover 30*b* can include many of the same features as the cover 30 shown in FIG. 2 and the cover 30*a* shown in FIG. 3. The cover 30*b* includes a pair of internal bosses 70 positioned inward from a perimeter wall 38 proximate either side 44, 46 of the wall 38. Each internal boss 70 includes an aperture 72 formed therein that extends partially therethrough to a depth sufficient to engage with a corresponding rod 26*a* or 26*b* and hold the cover 30*b* in a desired position (i.e., second position) with respect to the switch housing 12. The cover 30*b* includes a plurality of stiffening ribs 74 extending from an inner surface 76 of the front wall 36. It should be noted that stiffening ribs 74 similar to those illustrated in FIG. 6 may optionally be formed with any embodiment of the various covers 30*a*, 30*b*, and 30*c* defined in the present disclosure.

Figure 7:
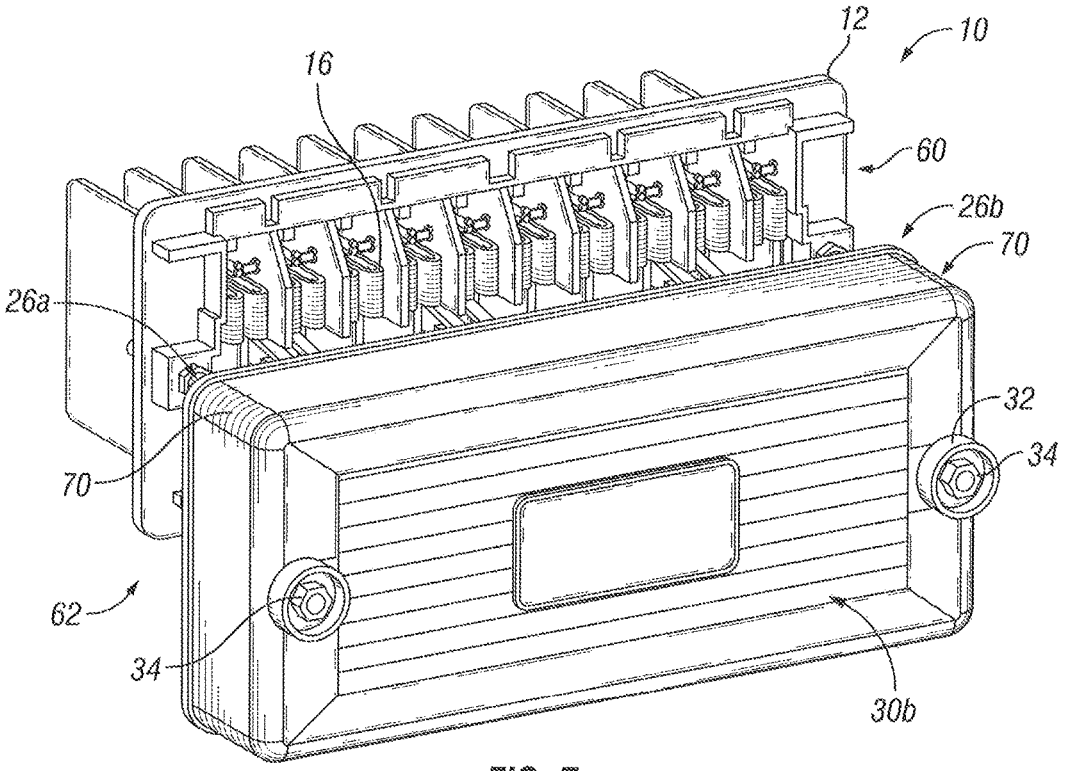
FIG. 7 is a perspective view of switch cover of FIG. 6 attached to the switch assembly of FIG. 1 in a second position.

Referring now to FIG. 7, the cover 30*b* is held in a second position with respect to switch housing 12 by way of engaging the rods 26*a* and 26*b* within a corresponding internal boss 70. The internal bosses 70 of the cover 30*b* can slide over the rods 26*a*, 26*b* until the first end 27 of the rods extend far enough into the apertures 72 to hold the cover 30*b* in place. In some forms the first end 72 of the rods 26*a*, 26*b* may extend into the apertures a distance sufficient to engage an end wall (not shown) at a distal end of the aperture entry location. It should be noted with this embodiment or others, that in some forms a cross sectional size and shape of the apertures 72 may be of similar size and shape to that of the rods 26*a*, 26*b*. In other forms the apertures 72 may be different in terms of size and/or shape along a portion thereof from the size or shape of the rods 26*a*, 26*b* such that a press fit between the rods 26*a*, 26*b* and the apertures 72 may be employed.

Figure 8:
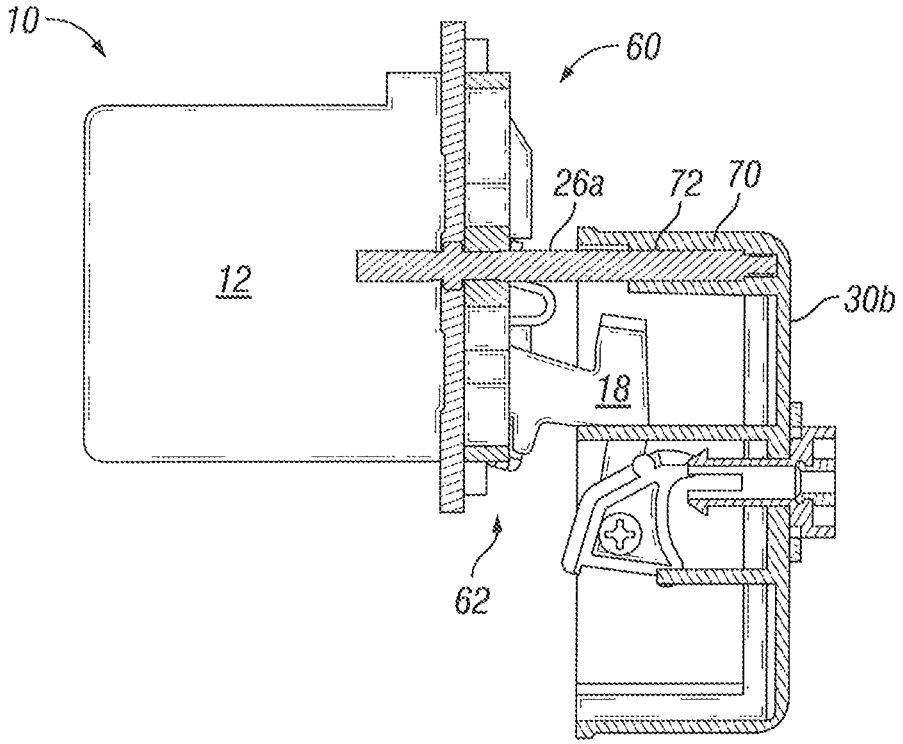
FIG. 8 is a side view of FIG. 7 with portions in cross-section and partially cutaway.

Referring now to FIG. 8, a partial cross-sectional side view of the switch assembly 10 as shown in FIG. 7 is depicted. A rod 26*a* can be engaged within an aperture 72 to hold the cover 30*b* in a position that at least partially covers an open blade 18 and other electrical components in the lower portion 62 while providing access to the upper portion 60 of the switch assembly 10.

Figure 9:
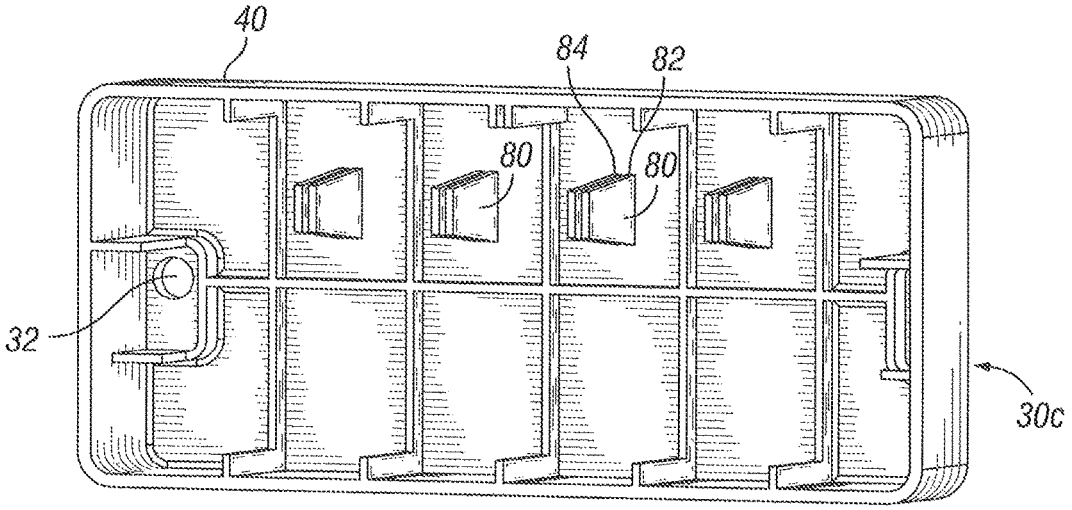
FIG. 9 is a perspective view of a switch cover according to another embodiment of the present disclosure.

Referring now to FIG. 9, another embodiment of the present disclosure is illustrated. A cover 30*c* may have many similar features to those of covers 30*a* and 30*b*. The cover 30*c* includes one or more blade clamps 80 that are configured to engage a corresponding switch blade 18 when the switch blade 18 is in an open position. Each blade clamp 80 includes a first paw 82 and an opposing second paw 84 configured to engage with a switch blade 18 when the blade 18 is in an open position. The first and second paws 82, 84 can engage about either side of a corresponding switch blade 18 in a press fit configuration so as to hold the cover 30*c* in a position that at least partially covers an open blade 18 and other electrical components in the lower portion 62 while providing access to the upper portion 60 of the switch assembly 10. Locking engagement of the blade clamps 80 with corresponding switch blades 18 can include mechanical connections in addition to, or in lieu of, press fit means, by the way of example and not limitation, mechanical clips, snap lock fittings, interlocking grooves or the like may be used to interconnect the blade clamps 80 and in switch blades 18.

Figure 10:
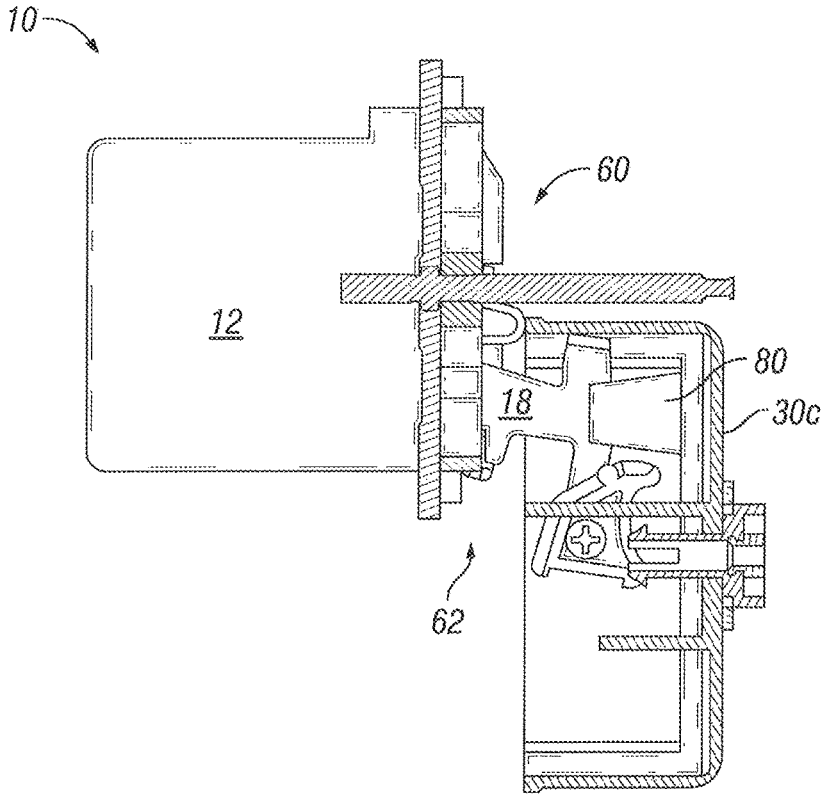
FIG. 10 is a side view of the cover of FIG. 9 attached to a switch assembly in a second position with portions in cross-section and partially cutaway.

Referring to FIG. 10, a partial cross-sectional side view of the switch assembly 10 as shown in FIG. 7 is depicted. A switch blade 18 in an open position can be engaged by a corresponding blade clamp 80 so as to hold the cover 30*c* in a position that at least partially covers an open blade 18 and other electrical components in the lower portion 62 while providing access to the upper portion 60 of the switch assembly 10.

Figure 11:
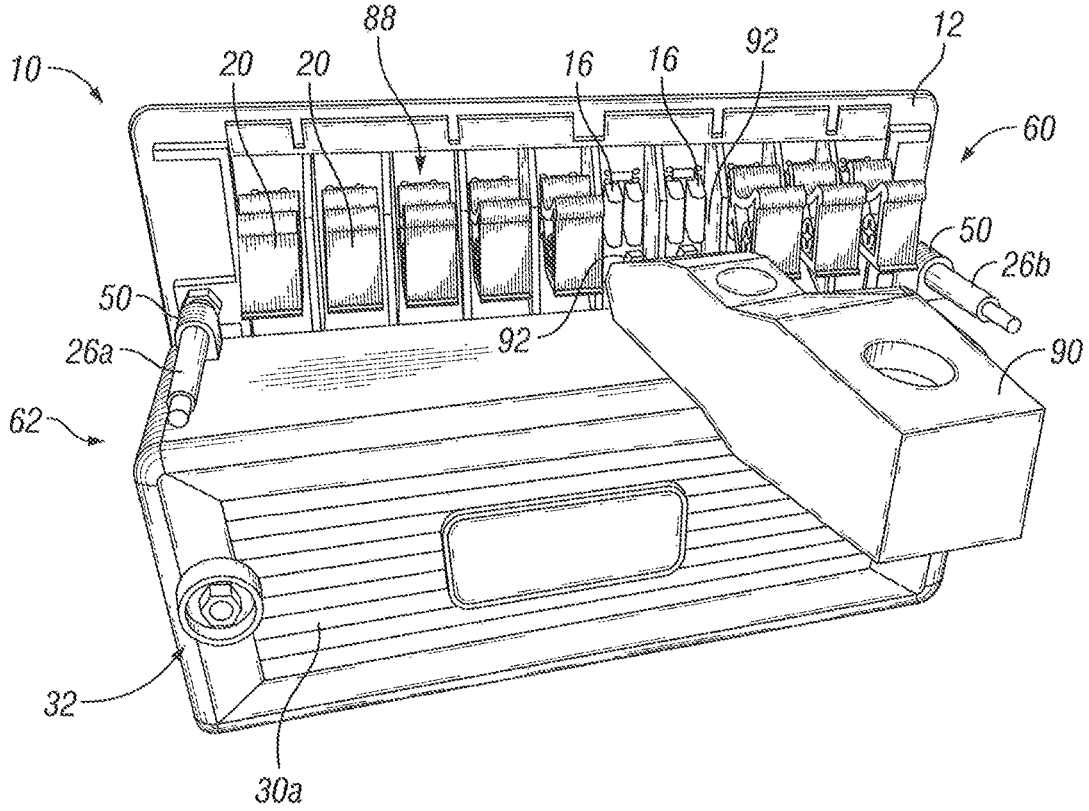
FIG. 11 is a perspective view of a switch assembly with a cover positioned to permit circuit testing with a test plug.

Referring now to FIG. 11, an illustrative embodiment showing a cover 30*a* removed from a standard or first position that encloses the entire housing 12 and has been moved to a second position or testing position. The cover 30*a* is engaged with the switch housing 12 such that the eyelets 50 of the cover 30 are slidingly engaged about the rods 26*a*, 26*b* of the housing 12 at either end thereof. When the cover 30*a* is placed in this position, testing and analysis of individual circuits can be performed. In one aspect, an electronic test module such as a test plug 90, illustrated herein, can be engaged with one or more current jack springs 24 (see FIG. 1) through one or more conducting probes 92.

In this manner a circuit electrically coupled to the current jack springs 24 can be analyzed by the test plug 90. When a circuit is closed, the switch blade 18 is moved to a closed position as illustrated when the handle 20 is visible in the upper portion 60 of the switch assembly 12. When the test plug 90 is connected to one or more jaws 16, various electrical tests such as continuity checks, voltage checks, and current checks may be employed by an operator while the cover 30*a* restricts inadvertent contact with electrically hot components in the lower portion 62 of the switch assembly 10. It should be noted that while a test plug 90 with two conducting probes 92 is illustrated in FIG. 11, that other types of test plug(s) 90 may also be used without departing from the teachings herein. By way of example and not limitation, the test plug 90 may be configured to simultaneously test any number of switches 14 when the switch cover 30*a*, 30*b* or 30*c* is moved to the second or test position.

In operation, a switch assembly 10 having a cover 30*a*, 30*b* or 30*c* can be tested or analyzed by removing the cover 30*a*, 30*b* or 30*c* from the housing 12 from a first or closed position. The cover 30*a*, 30*b* or 30*c* can be removed from the housing 12 by removing one or more fasteners 34 from the rods 26*a*, 26*b* and sliding the cover 30*a*, 30*b* or 30*c* over the rods 26*a*, 26*b*. The cover 30*a*, 30*b* or 30*c* can then be placed in a second position to provide access to the circuits while simultaneously protecting an operator from inadvertent contact with certain electrical components. Covers 30*a* or 30*b* can be connected to the rods 26*a*, 26*b* through eyelets 50 or internal bosses, respectively. Cover 30*c* can be connected to the blades 18 via the blade clamps 80. In some embodiments, a cover may include more than one of the attachment features defined by eyelets 50, the internal bosses 70 and the blade clamps 80 to permit optional attachment means for the cover 30*a*, 30*b* or 30*c*. Once the cover 30*a*, 30*b* or 30*c* is moved to the second position, the upper portion 60 of the switch assembly 10 is at least partially accessible while access to the lower portion 62 of the switch assembly 10 is restricted thereby reducing the potential for inadvertent contact with a hot electrical component. An operator can then test various circuits in the system using a test apparatus such as a test plug 90 or the like. The test plug 90 may be connected to the jaws 16 to facilitate determination of any potential bad circuits or confirm good working circuits. After analysis is complete the cover 30*a*, 30*b* or 30*c* can be moved from the second position back to the first position by installing the rods 26*a*, 26*b* through the stud bosses 32 and fastening the cover to the housing with a threaded fastener 34 or other fastening means.

In one aspect, the present disclosure includes combination comprising: a switch assembly including; a housing; electrical conductive elements located within the housing; at least one switch blade formed from a conductive element movable between first and second positions; a cover configured to couple with the housing in at least two locations; and the switch cover completely encloses all of the electrically conductive elements in a first location and the switch cover encloses less than all of the electrically conductive elements in a second location.

In refined aspects the second position of the switch blade defines an open switch; the cover limits access to the switch blade when the switch blade is in the second position and cover is in the second location; the cover permits access to electrically conductive components that are electrically isolated from the switch blade when the switch blade is in the second position and cover is in the second location; the housing includes an elongate rod extending therefrom; the cover includes an aperture extending through a wall of the cover configured to receive the elongate rod therethrough when the cover is coupled to the housing in the first location; the cover includes an internal boss extending from a wall configured to receive the elongate rod therein when the cover is coupled to the housing in the second location; the cover includes an eyelet extending from a perimeter wall configured to receive the elongate boss therethrough when the cover is coupled to the housing in the second location; the cover includes a clip extending from a wall configured to clamp onto a portion of one of the switch blades when the cover is coupled to the housing in the second location; the rod is externally threaded and adapted to receive a threaded nut to releasably lock the cover to housing; further comprising a test plug electrically connectable to the switch assembly when the at least one blade is in the second position and the cover is in the second location; the housing is formed from a non-conductive material; the housing includes first and second elongate rods positioned at opposing ends thereof; the cover includes connecting features to permit coupling engagement with the first and second elongate rods in each of the at least two locations.

In yet another aspect, the present disclosure includes a cover for an electrical switch comprising: a front wall; a perimeter wall extending around the front wall; a primary coupling feature configured to permit coupling with a switch housing in first position that prevents access to all electrically conductive components; and a secondary coupling feature configured to permit coupling with a switch housing in a second position to permits access to only a portion of the electrically conductive components.

In refined aspects, the cover is formed from a non-conductive material; the primary coupling feature includes first and second apertures extending through the front wall of the cover; the secondary coupling feature includes an eyelet protruding outward from the perimeter wall of the cover; the eyelet is configured to receive a stud extending from a housing of the electrical switch; the secondary coupling feature includes a boss positioned inward of the perimeter wall, the boss including an elongate hole formed partially therethrough; the boss is configured to receive a stud extending from a housing of the electrical switch; the secondary coupling feature includes a jaw extending inward from the front wall; the jaw is configured to engage with a blade of an electrical switch when the blade is in an open position.

In yet another aspect, the present disclosure includes a method comprising: covering all electrical conductive elements of a switch assembly in a first configuration; covering a portion of all of the electrical conductive elements in a switch assembly in a second configuration; and testing an electrical circuit when the switch assembly is in a second configuration.

In refined aspects, the second configuration includes moving at least one blade from a jaw to an open position; the testing includes accessing a current jack spring of a corresponding blade in an open position with a test plug.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and Indirect mountings, connections, supports, and couplings. Further, "connected" and "coupled" are not restricted to physical or mechanical connections or couplings.

What is claimed is:

1. A cover for an electrical switch comprising:

a front wall;

a perimeter wall extending around the front wall, the front wall and the perimeter wall defining an inner region of the cover, a primary coupling feature sized and positioned to permit coupling of the cover with a portion of a switch housing in a first position that prevents access to all electrically conductive components, the primary coupling feature including a first aperture and a second aperture that each extends through the front wall and is in direct fluid communication with the inner region of the cover, the first aperture being separated from the second aperture by a first distance; and a secondary coupling feature sized and positioned to permit coupling of the cover with the portion of the switch housing in a second position to permit access to only a portion of the electrically conductive components, the secondary coupling feature extending outwardly from the perimeter wall, the secondary coupling feature comprising a third aperture and a fourth aperture that are separated by a second distance, the first distance and the second distance being the same such that the primary coupling feature and the secondary coupling feature are positioned to be coupled to a same portion of the switch housing, wherein the third and fourth apertures each comprise an eyelet that protrudes outward from the perimeter wall of the cover.

2. The cover of claim 1, wherein the cover is formed from a non-conductive material.

3. The cover of claim 1, wherein the first and second apertures extend through the front wall of the cover, and wherein a portion of the primary coupling feature is positioned within the inner region of the cover.

4. The cover of claim 1, wherein the eyelet is configured to receive a rod extending from the switch housing.

* * * * *